US005887229A

United States Patent [19]

Sass et al.

[11] Patent Number: 5,887,229

[45] Date of Patent: Mar. 23, 1999

[54] PHOTORECEPTOR SHIPPING INSTALLATION CLIP FOR XEROGRAPHIC CUSTOMER REPLACEABLE UNIT (CRU)

[75] Inventors: Douglas W. Sass, Ontario; Alvin J. Owens, Jr., Fairport; David E. Rollins, Lyons, all of N.Y.

[73] Assignee: Xerox Corporation, Stamford, Conn.

[21] Appl. No.: 837,929

[22] Filed: Apr. 11, 1997

[51] Int. Cl.[6] ..... G03G 15/00

[52] U.S. Cl. ..... 399/116; 399/162

[58] Field of Search ..... 399/110, 111, 399/116, 125, 162, 159; 347/138, 152; 206/499

[56] References Cited

U.S. PATENT DOCUMENTS

| | | | |
|---|---|---|---|
| 4,551,001 | 11/1985 | Yokota | 399/116 |
| 5,119,134 | 6/1992 | Haneda et al. | 399/116 |
| 5,243,384 | 9/1993 | Everdyke et al. | 399/116 |
| 5,307,117 | 4/1994 | Harlan | 399/114 |
| 5,400,121 | 3/1995 | Foote | 399/116 |
| 5,787,322 | 7/1998 | Sass et al. | 399/110 |

*Primary Examiner*—Arthur T. Grimley
*Assistant Examiner*—Sophia S. Chen
*Attorney, Agent, or Firm*—Kevin R. Kepner

[57] ABSTRACT

A retaining device for a photoreceptive member in a xerographic CRU. The belt in a CRU is retained by the device and held in a shape so that it will slide easily over a drive module without catching on other machine components. The device is made up of a plurality of fingers that hold the belt in position during shipment and installation. Once the CRU is installed and an interlock handle turned, the belt is released from the fingers and is in an operative, supported position on the drive module. To remove the CRU, the interlock mechanism is reversed and the belt is again captured by the fingers and held in a shape to allow easy removal over the drive module.

7 Claims, 5 Drawing Sheets

PHOTORECEPTOR SHIPPING INSTALLATION CLIP FOR XEROGRAPHIC CUSTOMER REPLACEABLE UNIT (CRU)

This invention relates generally to a xerographic customer replaceable unit (CRU), and more particularly concerns a device for protecting and constraining a photoreceptive member within a CRU housing during shipment and/or installation.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In printing machines such as those described above, a CRU is a customer replaceable unit which can be replaced by a customer at the end of life or at the premature failure of one or more of the xerographic components. The CRU concept integrates various subsystems whose useful lives are predetermined to be generally the same length. The service replacement interval of the CRU insures maximum reliability and greatly minimizes unscheduled maintenance service calls. Utilization of such a strategy, allows customers to participate in the maintenance and service of their copiers/printers. CRUs insure maximum up time of copiers and minimize downtime and service cost due to end of life or premature failures.

It is desirable to have a CRU that enables a variety of machine subsystems to be incorporated into a single unit while maximizing the useful life of each component. It is further desirable to utilize a CRU that allows service to a machine to be performed efficiently and at a relatively low cost and in some cases to be serviced by the user himself. It is a further benefit to have the ability to reuse and recycle various CRU components in today's climate of environmental awareness.

The CRU housing provides a protected case in which to ship many of the delicate xerographic components for a printing machine. One of the most delicate components is the photoreceptor, which is often a coated Mylar substrate which is susceptible to damage by scratching or creasing which will result in print defects. It is also preferred to maintain a photoreceptor in a dark environment to prevent light shock which can also result in premature failure of the photoreceptor and print defects.

It is desirable to provide a device which allows a photoreceptive member to be protectively shipped within a CRU housing and will also allow installation of the housing, including the photoreceptor, with a minimum of handling or exposure to light or physical abuse.

In accordance with one aspect of the present invention, there is provided a retaining device for a photoreceptive member, comprising a housing containing the photoreceptive member and a plurality of retaining members located on the housing to retain the photoreceptive member in a predefined shape, wherein upon insertion of said housing into a printing machine and actuation of an engagement member the photoreceptive member is released from said plurality retaining member.

Pursuant to another aspect of the present invention, there is provided an electrophotographic printing machine having a xerographic CRU containing a photoreceptive member wherein the CRU has a retaining device for constraining and protecting the photoreceptive member, comprising a plurality of retaining members located on the CRU to retain the photoreceptive member in a predefined shape, wherein upon insertion of the CRU into the printing machine and actuation of an engagement member the photoreceptive member is released from said plurality retaining member.

Pursuant to yet another aspect of the present invention, there is provided a xerographic CRU containing a photoreceptive member wherein the CRU has a retaining device for constraining and protecting the photoreceptive member, comprising a plurality of retaining members located on the CRU to retain the photoreceptive member in a predefined shape, wherein upon insertion of the CRU into the printing machine and actuation of an engagement member the photoreceptive member is released from said plurality retaining member.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
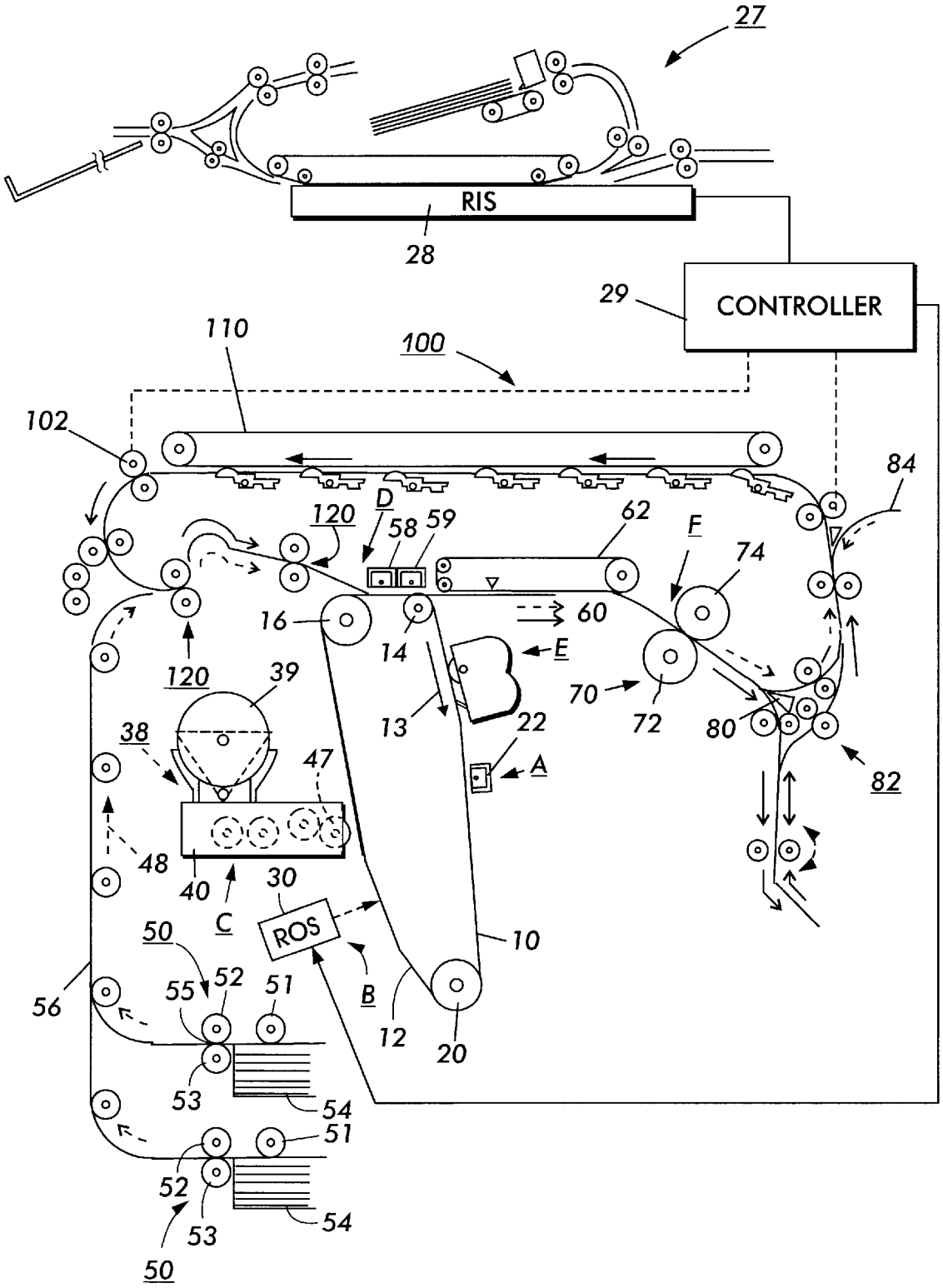
FIG. 1 is a schematic elevational view of a typical electrophotographic printing machine utilizing the photoreceptor shipping/installation clip of the present invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the photoreceptor shipping/installation clip of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 39, dispenses toner particles into developer housing 40 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120 of the invention herein, described in detail below, past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
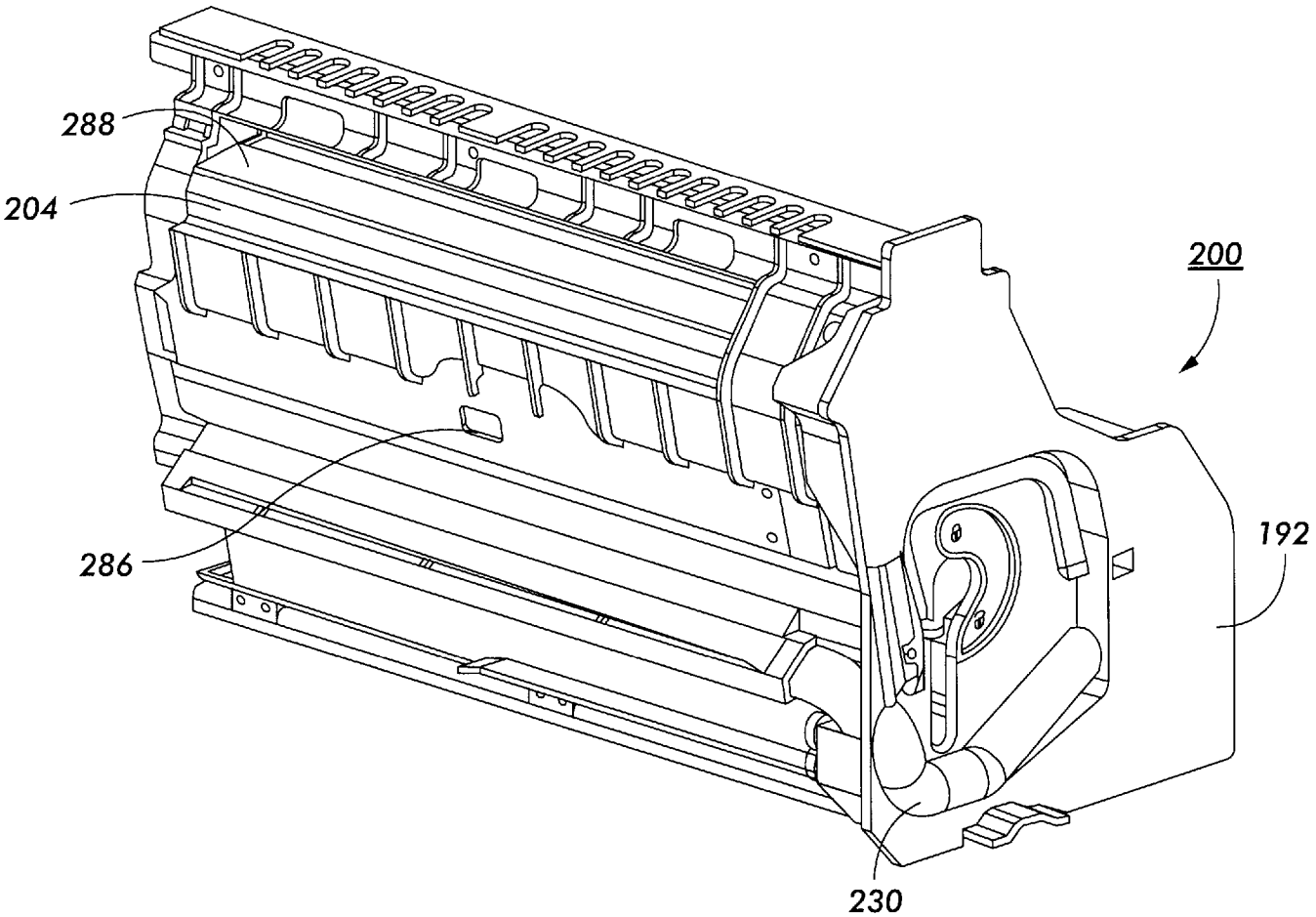
FIG. 2 is a perspective view of one side of a xerographic CRU.
Figure 3:
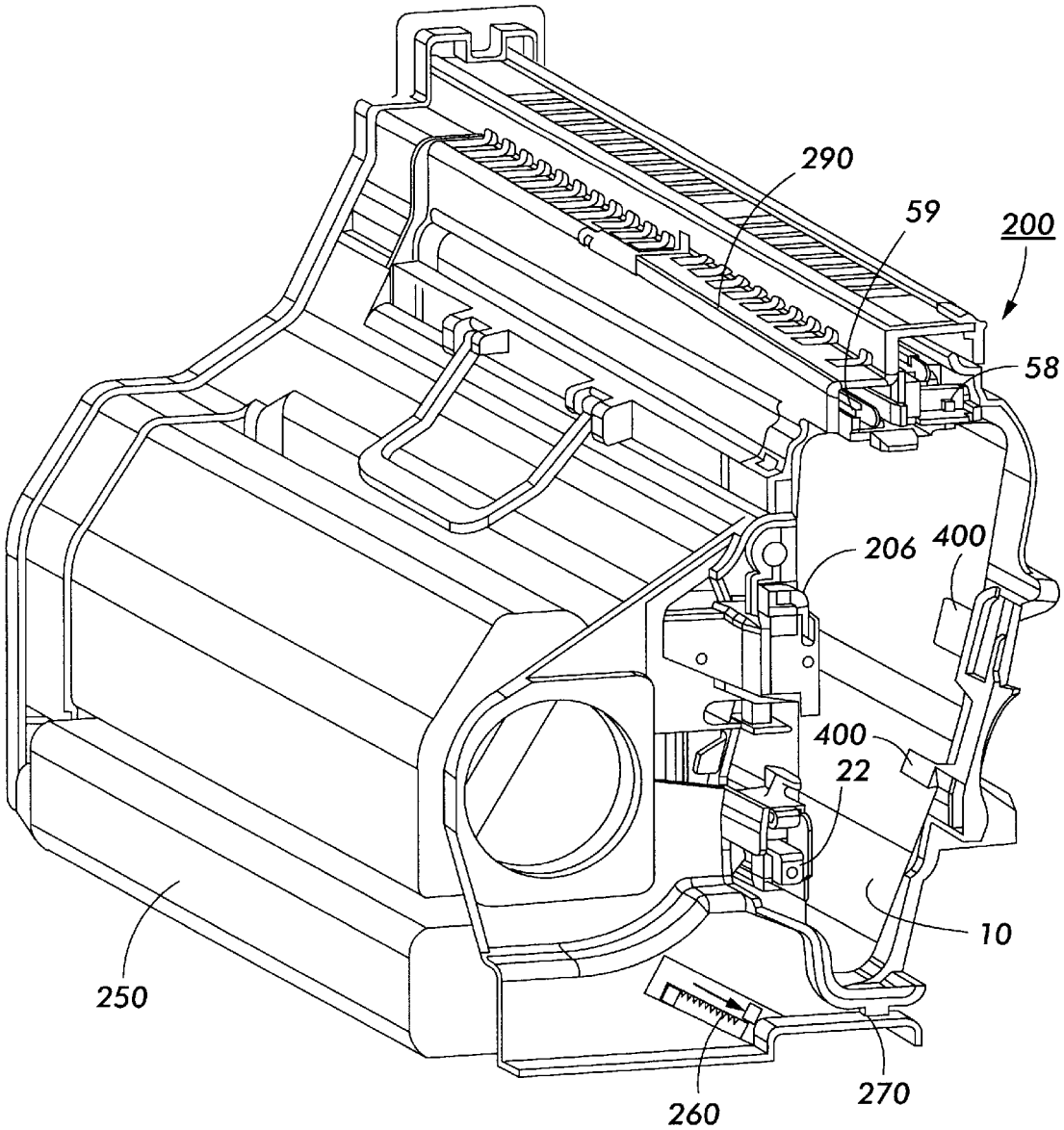
FIG. 3 is a perspective view of the opposite side of the FIG. 2 CRU.
Figure 5:
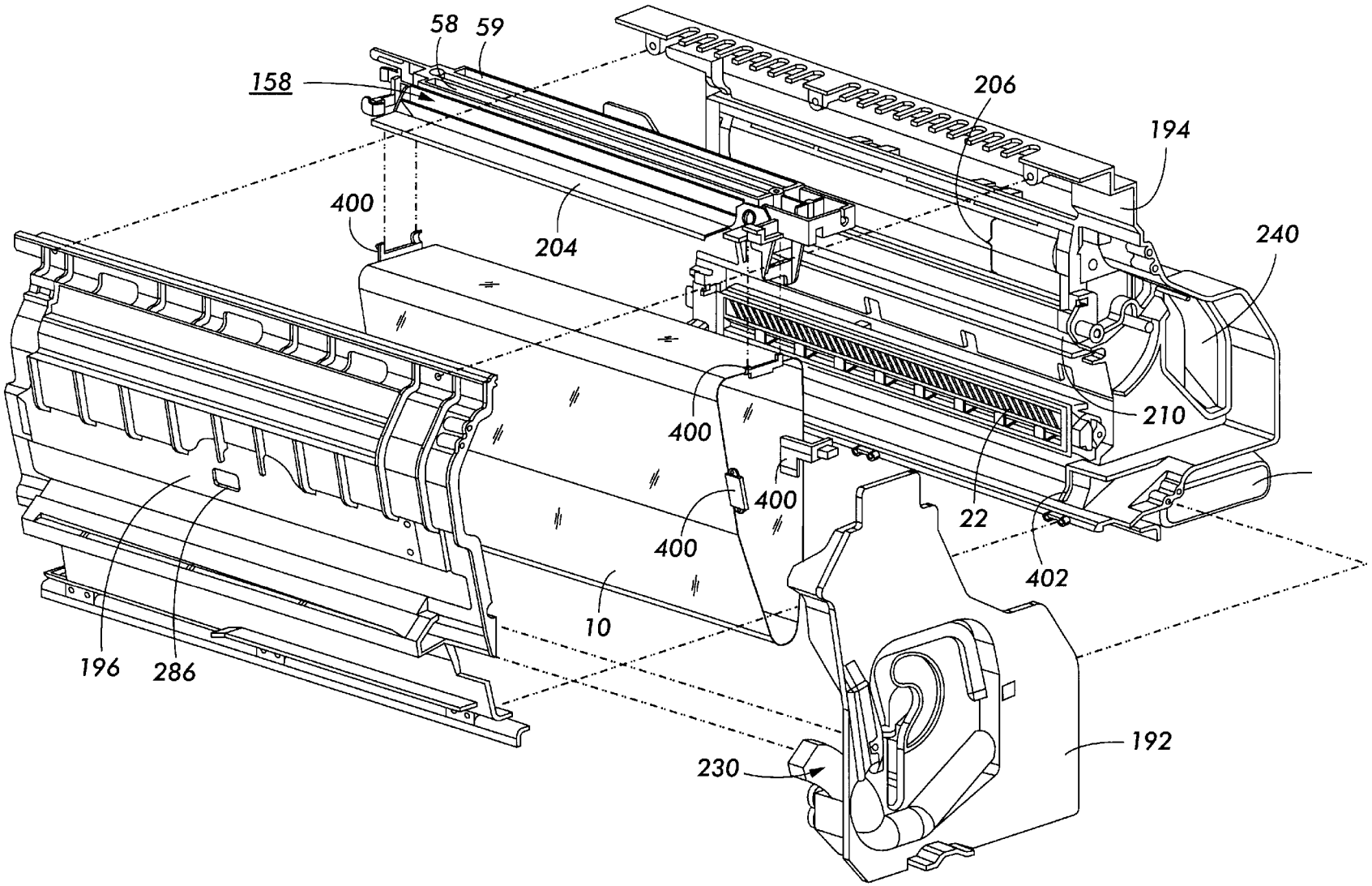
FIG. 5 is an exploded perspective view of the xerographic CRU module further illustrating the components thereof including the retaining members of the present invention.

Turning next to FIGS. 2, 3 and 5, there is illustrated perspective views and an exploded perspective view of the xerographic customer replaceable unit (CRU) 200. The xerographic CRU 200 module mounts and locates xerographic subsystems in relationship to the photoreceptor module 300 and xerographic subsystem interfaces. Components contained within the xerographic CRU include the transfer/detack corona generating devices 58, 59, the pretransfer paper baffles 204, the photoreceptor cleaner 206, the charge scorotron 22, the erase lamp 210, the photoreceptor (P/R) belt 10, the noise, ozone, heat and dirt (NOHAD) handling manifolds 230 and filter 240, the waste bottle 250, the drawer connector 260, CRUM 270, the automatic cleaner blade engagement/retraction and automatic waste door open/close device (not illustrated).

A summary of the xerographic CRU components and the function of each is as follows:

Cleaner 206 (Doctor blade and Disturber Brush): remove untransferred toner from the photoreceptor; transport waste toner and other debris to a waste bottle for storage; assist in controlling the buildup of paper talc, filming and comets on the photoreceptor belt.

Precharge Erase Lamp 210: provides front irradiation of the photoreceptor to the erase the electrostatic field on the surface Charge Pin Scorotron 22: provides a uniform charge level to the photoreceptor belt in preparation for imaging.

Photoreceptor Belt 10: charge retentive surface advances the latent image portions of the belt sequentially through various xerographic processing stations which converts electrostatic field on the surface Pretransfer Paper Baffles 204: directs and controls tangency point between the paper and photoreceptor surface. Creates an "S" bend in paper to flatten sheet in the transfer zone.

Transfer Wire Corotron 58: places a charge on the paper as in passes under the corotron. The high positive charge on the paper causes the negative charged toner to transfer from the photoreceptor to the paper.

Detack Pin Corotron 59: assist in removing paper with its image from the photoreceptor by neutralizing electrostatic fields which may hold a sheet of paper to photoreceptor 10. Sheet self strips as it passes over a stripper roll 14 on belt module 300.

NOHAD Dirt Manifolds 230 and Filter 240: removes airborne toner dirt and contaminates from the moving air before it leaves the CRU. The captured toner and contaminates are deposited in a dirt filter contained in the xerographic CRU.

Electrical Drawer Connector 260: provides connector interface for the CRUM; provides input/output for machine control.

CRUM Chip 270: allows machine to send reorder message (user interface or automatically) for CRU or other; method to monitor number of copies purchased by the customer and warrantee the CRU for premature CRU failures; provides handshake feature with machine to ensure correct CRU installed in compatible machine; shuts down machine at the appropriate CRU kill point; enables market differentiation; enables CRU life cycle planning for remanufacture; enables remote diagnostics; provides safety interlock for the ROS.

ROS and Developer Interface: provides a developer interface window to allow transfer of toner for imaging from developer donor roll 47 to P/R belt surface 12 latent image; Also, provides critical parameter mounting and location link which ties ROS 30 to P/R module 300 to ensure proper imaging and eliminate motion quality issues.

BTAC Sensor Interface 286: provides interface window to monitor process controls.

Registration Transport Interface 288: provides outboard critical parameter location and mounting feature.

Prefuser Transport Interface 290: provides critical parameter location and mounting feature.

The CRU subsystems are contained within the xerographic housing 200. The housing consist of three main components which include the front end cap 192, right side housing 194 and left side housing 196. The xerographic housing 200 is a mechanical and electrical link. It establishes critical parameters by mounting and locating subsystems internal and external to the CRU in relationship to the photoreceptor module 300 and other xerographic subsystem interfaces. The housing allows easy reliable install and removal of the xerographic system without damage or difficulty.

Figure 4:
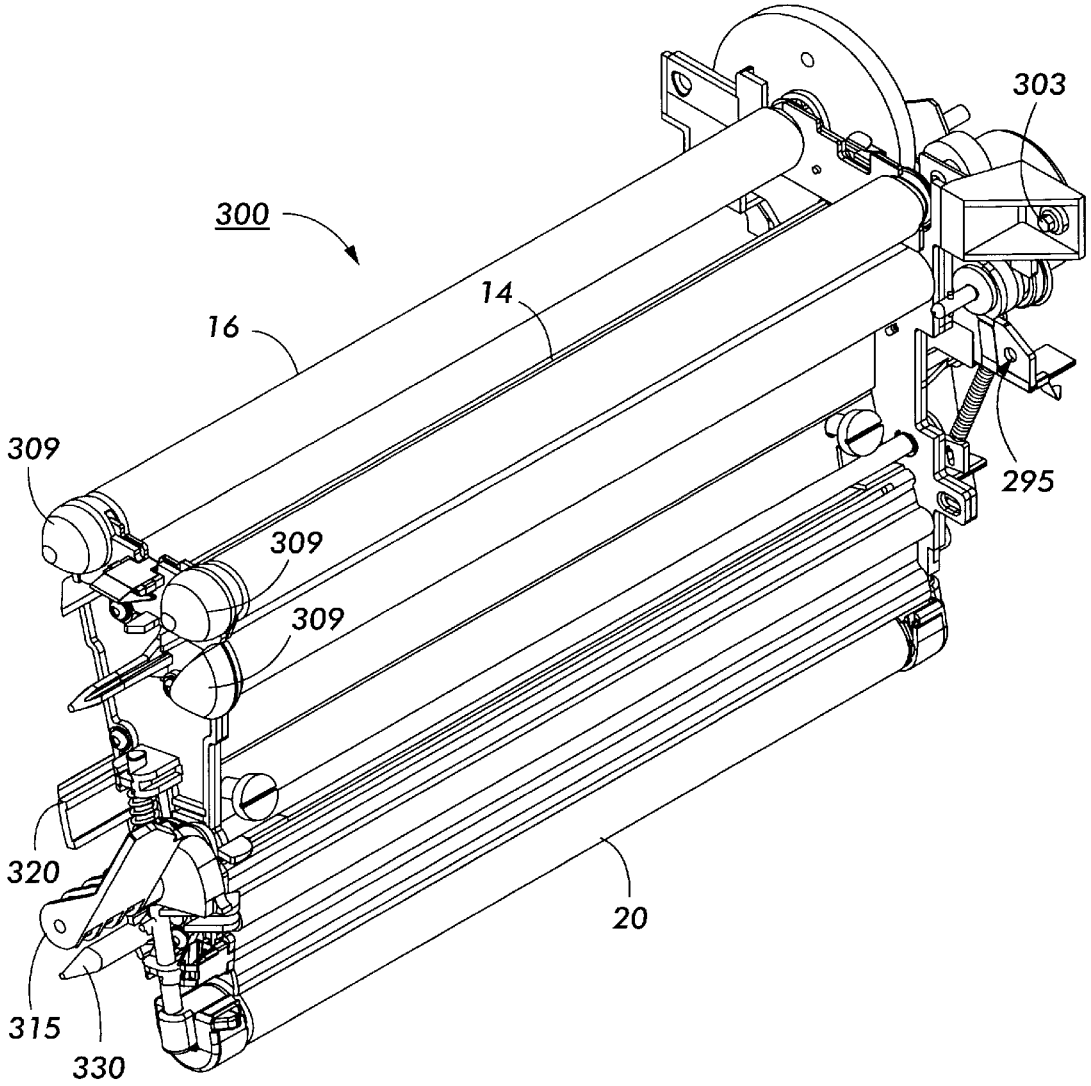
FIG. 4 is a perspective view of the photoreceptor belt drive module.

Turning next to FIG. 4 the P/R module 300 is shown, the module, generally referred to as reference numeral 300, must interface with several sub systems: xerographic charging, imaging, development, paper registration, transfer, cleaning, erase, the machine frames, and the xerographic CRU. The unit's primary function is to rotate the photoreceptor (P/R) belt 10 to the various xerographic sub systems in order to transfer a toner image from the belt to a sheet of paper.

The photoreceptor (P/R) module 300 is mounted to the machine frames on the machine frames backplate with two fasteners using mounting holes 303,. The imager backer bar 330 locates in a hole in the machine frames backplate. A second feature, to eliminate rotation, is on the P/R module rear plate. When mounted, the P/R module 300 is cantilevered off the machine frames backplate until the xerographic CRU 200 is inserted into position.

By rotating the P/R module handle 315 clockwise to a substantially vertical position, the tension roll 20 and developer backer bar 320 are contracted, allowing the user to insert/remove the xerographic CRU 200 without interference or damage to components. After the xerographic CRU 200 is fully inserted, the user rotates the handle 315 counter clockwise approximately 1500 to return the tension roll 20 and developer backer bar 320 to their operating positions.

As seen in FIGS. 3 and 5 the P/R belt is partially retained by molded fingers 400 which are located on the inboard and outboard areas of the right housing 194. Other retaining belt fingers 400 are located on the transfer detack housing 158 and left side housing 196. The housing has a molded feature 402 at the lower outboard end which positions the belt 10 on the P/R module 300 to prevent belt damage.

The fingers 400 retain the belt 10 and hold it in position during shipping and during installation of the CRU 200. The fingers 400 guide the belt 10 and cooperate with features 309 on the P/R module 300 to allow the belt 10 to slide safely into position when the CRU is inserted in the machine over the P/R module 300. When handle 315 is turned to extend the tension roll 20 and the developer backer bar 320 and cleaner brush and doctor blade, referred to generally as 206, the fingers 400 release the belt and it is then supported on the P/R drive module rolls 14, 16, 20. When the handle is rotated in the opposite direction to remove the CRU 200, the fingers 400 again capture the belt 10 and hold it in a shape to clear the P/R module 300. The fingers 400 provide a way to prevent damage to the belt 10 by preventing the belt from catching or otherwise being damaged by the CRU 200 or the P/R module 300 during installation and removal of the CRU and also by restraining the belt 10 during shipment.

While the invention herein has been described in the context of a xerographic CRU utilizing a modular photoreceptor drive unit for a black and white printing machine, it will be readily apparent that the device can be utilized in any printing machine utilizing a modular xerographic CRU.

In recapitulation, there is provided a retaining device for a photoreceptive member in a xerographic CRU. The belt in a CRU is retained by the device and held in a shape so that it will slide easily over a drive module without catching on other machine components. The device is made up of a plurality of fingers that hold the belt in position during shipment and installation. Once the CRU is installed and an interlock handle turned, the belt is released from the fingers and is in an operative, supported position on the drive module. To remove the CRU, the interlock mechanism is reversed and the belt is again captured by the fingers and held in a shape to allow easy removal over the drive module.

It is, therefore, apparent that there has been provided in accordance with the present invention, a device for retaining and protecting a photoreceptive member during shipment and installation that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A retaining device for a photoreceptive member, comprising:

a housing containing the photoreceptive member;

a plurality of retaining members located on the housing to retain the photoreceptive member in a predefined shape, wherein upon insertion of said housing into a printing machine and actuation of an engagement member the photoreceptive member is released from said plurality of retaining members.

2. A retaining device according to claim 1, wherein upon disengagement of said engagement member the photoreceptive member is captured by said retaining members and configured in a shape to facilitate removal of said housing.

3. A retaining device for a photoreceptive member, comprising:

a housing containing the photoreceptive member;

a plurality of retaining members located on the housing to retain the photoreceptive member in a predefined shape, wherein upon insertion of said housing into a printing machine and actuation of an engagement member the photoreceptive member is released from said plurality of retaining members wherein said retaining members comprise a plurality of substantially L-shaped members located along the periphery of an opening in said housing adjacent an outer edge of the photoreceptive member and arranged so as to retain the photoreceptive member in a generally triangular configuration.

4. An electrophotographic printing machine having a xerographic Customer Replaceable Unit (CRU) containing a photoreceptive member wherein the CRU has a retaining device for constraining and protecting the photoreceptive member, comprising a plurality of retaining members located on the CRU to retain the photoreceptive member in a predefined shape, wherein upon insertion of the CRU into the printing machine and actuation of an engagement member the photoreceptive member is released from said plurality of retaining members.

5. A printing machine according to claim 4, wherein upon disengagement of said engagement member the photoreceptive member is captured by said retaining members and configured in a shape to facilitate removal of the CRU.

6. A xerographic Customer Replaceable Unit (CRU) containing a photoreceptive member wherein the CRU has a retaining device for constraining and protecting the photoreceptive member, comprising a plurality of retaining members located on the CRU to retain the photoreceptive member in a predefined shape, wherein upon insertion of the CRU into the printing machine and actuation of an engagement member the photoreceptive member is released from said plurality of retaining members.

7. A CRU according to claim 6, wherein upon disengagement of said engagement member the photoreceptive member is captured by said retaining members and configured in a shape to facilitate removal of the CRU.

* * * * *